US007930786B2

(12) United States Patent
La Belle et al.

(10) Patent No.: US 7,930,786 B2
(45) Date of Patent: Apr. 26, 2011

(54) METHOD FOR DETERMINING LOAD SIZE AND/OR SETTING WATER LEVEL IN A WASHING MACHINE

(75) Inventors: Kathleen M. La Belle, Lawrence, MI (US); Jenn-Yeu Nieh, Saint Joseph, MI (US); Laura C. Oskins, Saint Joseph, MI (US); Bennett J. Cook, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 456 days.

(21) Appl. No.: 12/058,841

(22) Filed: Mar. 31, 2008

(65) Prior Publication Data

US 2009/0241270 A1 Oct. 1, 2009

(51) Int. Cl.
*D06F 33/02* (2006.01)

(52) U.S. Cl. ..... 8/159; 68/12.04; 68/12.05; 68/12.21

(58) Field of Classification Search ..... 8/159; 68/12.04, 68/12.05, 21
See application file for complete search history.

(56) References Cited

U.S. PATENT DOCUMENTS

| | | | | |
|---|---|---|---|---|
| 4,303,406 | A | | 12/1981 | Ross |
| 4,400,838 | A | | 8/1983 | Steers et al. |
| 4,503,575 | A | | 3/1985 | Knoop et al. |
| 4,528,709 | A | | 7/1985 | Getz et al. |
| 4,697,293 | A | | 10/1987 | Knoop |
| 4,733,547 | A | | 3/1988 | Honda |
| 4,835,991 | A | * | 6/1989 | Knoop et al. ..... 68/12.19 |
| 5,144,819 | A | * | 9/1992 | Hiyama et al. ..... 68/12.04 |
| 5,577,283 | A | | 11/1996 | Badami et al. |
| 5,768,729 | A | * | 6/1998 | Cracraft ..... 8/158 |
| 6,023,950 | A | | 2/2000 | Battistella |
| 6,151,742 | A | | 11/2000 | Dausch et al. |
| 6,292,966 | B1 | | 9/2001 | Lim et al. |
| 6,460,381 | B1 | | 10/2002 | Yoshida et al. |
| 2003/0041390 | A1 | | 3/2003 | Kim et al. |
| 2005/0257575 | A1 | | 11/2005 | Kang et al. |
| 2006/0283214 | A1 | | 12/2006 | Donadon et al. |
| 2008/0189875 | A1 | * | 8/2008 | Czyzewski et al. ..... 8/159 |

FOREIGN PATENT DOCUMENTS

| | | | | |
|---|---|---|---|---|
| DE | 30 30 491 | | * | 2/1982 |
| DE | 3309101 | A1 | | 9/1984 |
| DE | 3837202 | A1 | | 5/1990 |
| DE | 3842996 | A1 | | 7/1990 |
| DE | 41 22 307 | | * | 1/1993 |
| DE | 4122307 | A1 | | 1/1993 |
| DE | 4242414 | A1 | | 6/1994 |
| DE | 10 2006 030 891 | | * | 1/2008 |
| EP | 0644291 | A1 | | 3/1995 |
| GB | 2051413 | A | | 1/1981 |
| JP | 62-041691 | | * | 2/1987 |
| JP | 04-338491 | | * | 11/1992 |
| JP | 05-023474 | | * | 2/1993 |
| JP | 05-168790 | | * | 7/1993 |

(Continued)

*Primary Examiner* — Frankie L Stinson

(57) ABSTRACT

In a washing machine comprising a tub, an agitator, and a pressure sensor, a size of a fabric load may be determined and/or an operational water level may be set based on a time of supplying water to reach a timing water level in the tub and on variation in an output from the pressure sensor during agitation of the water and fabric load with the water at a agitation water level in the tub.

26 Claims, 6 Drawing Sheets

FOREIGN PATENT DOCUMENTS

| | | | |
|---|---|---|---|
| JP | 08-173681 | * | 7/1996 |
| JP | 62-064397 | * | 3/1997 |
| JP | 11-226295 | * | 8/1999 |
| JP | 2000-102691 | * | 4/2000 |
| KR | 2005066437 | * | 6/2005 |

* cited by examiner

METHOD FOR DETERMINING LOAD SIZE AND/OR SETTING WATER LEVEL IN A WASHING MACHINE

BACKGROUND OF THE INVENTION

The invention relates to a method for determining load size and/or setting a water level in a washing machine. For a wash process of a washing machine, the water level in the tub is typically set based on the size of a fabric load and, sometimes, the fabric type of the fabric load. The size of the fabric load may be manually input by the user through a user interface or may be automatically determined by the washing machine. For manual input by the user, the user may oftentimes overestimate or underestimate the load size, thereby resulting in too much or too little water, respectively, for the wash process. Too much water is wasteful, and too little water may lead to an insufficient wash performance. Many methods are known for the washing machine to automatically determine the load size and/or fabric type, such as by employing an output of the motor that drives the drum within the tub and the agitator within the drum. However, some lower end washing machines have motors that do not provide output useful for determining load size or have other limitations that preclude or make undesirable known methods for automatically determining load size.

SUMMARY OF THE INVENTION

A method for determining a size of a fabric load according to one embodiment of the invention in a washing machine comprising a wash tub, an agitator for agitating a fabric load in the tub, and a pressure sensor for sensing a level of water in the tub comprises determining whether the fabric load is a first qualitative size based on a time of supplying water to reach a timing water level in the tub, and if the fabric load is not the first qualitative size, determining whether the fabric load is a second qualitative size greater than the first qualitative size based on a variation in an output from the pressure sensor during agitation of the water and fabric load with the water at a agitation water level in the tub greater than the timing water level.

DESCRIPTION OF EMBODIMENTS OF THE INVENTION

Figure 1:
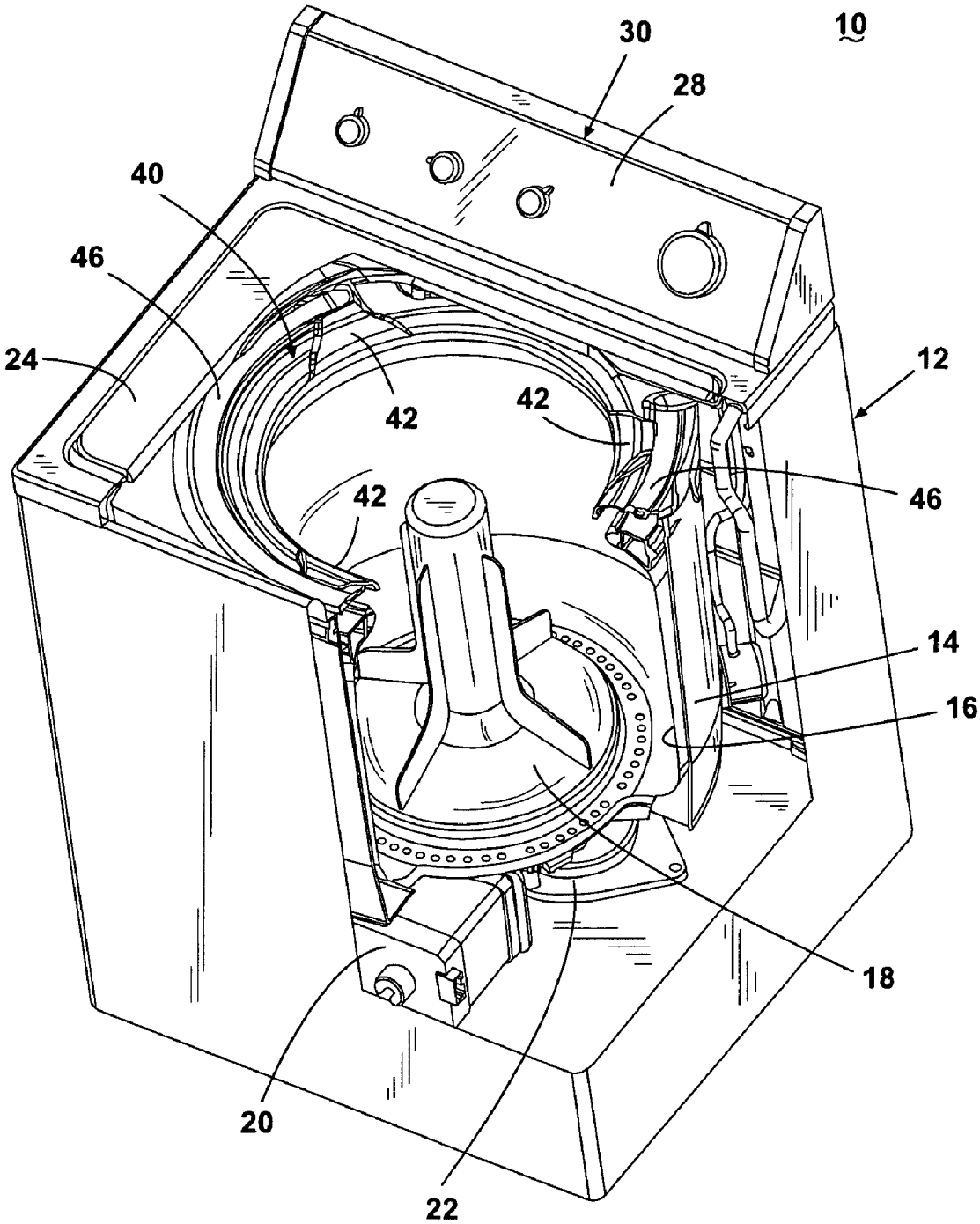
FIG. 1 is a front perspective view of an exemplary washing machine according to one embodiment of the invention with a portion cut-away to show interior components of the washing machine.

Referring now to the figures, FIG. 1 is a schematic view of an exemplary washing machine 10 according to one embodiment of the invention. The methods described herein may be used with any suitable washing machine and are not limited to use with the washing machine 10 described below and shown in the drawings. The washing machine 10 is described and shown for illustrative purposes.

The washing machine 10 includes a cabinet or housing 12, an imperforate tub 14, a perforated basket or drum 16 mounted within and rotatable relative to the tub 14, an agitator 18 mounted within and rotatable relative to and/or with the basket 16, and an electrically driven motor 20 operably connected via a transmission 22 to the agitator 18 and/or the basket 16. The transmission 22 may be a gear driven direct drive. The motor may be a brushless permanent magnet (BPM) motor direct drive, which may be coupled to and drive the transmission. An openable lid 24 on the top of the cabinet 12 provides access into the basket 16 through the baskets' open top. A user interface 28, which may be located on a console 30, may include one or more knobs, switches, displays, and the like for communicating with the user, such as to receive input and provide output.

A spraying system 40 may be provided to spray liquid (water or a combination of water and one or more wash aids) into the open top of the basket 16 and on top of any fabric load placed within the basket 16. The spraying system 40 may be configured to supply water directly from a household water supply and/or from the tub and spray it onto the fabric load. The spraying system 40 may also be configured to recirculate liquid from the tub, include a sump in the tub, and spray it onto the top of the fabric load. Other embodiments of the invention may use other water delivery techniques known to those skilled in the art.

As illustrated, the spraying system 40 may have one or more spray heads 42 directed into the open top of the basket 16. A liquid supply line (not shown) supplies liquid to a distribution manifold 46 integrated with the balancing ring to effect the supply of liquid to the spray heads 42. The supply line may be fluidly coupled to either or both of the household water supply or the tub as previously described. When liquid is supplied to the supply line from either the household supply or the tub, the liquid is directed to the spray heads 42 through the manifold 46 and is then emitted through the spray heads 42 into the open top of the basket 16 and onto any fabric load in the basket 16.

If the number, location, and coverage of the spray heads 42 is insufficient to substantially cover the basket 16, the basket may be rotated so that the fabric load is rotated beneath the spray heads for a more even wetting. However, the spray heads 42 as illustrated may be located and their spray coverage controlled such that they sufficiently evenly wet the fabric load in the basket without the need for rotating the basket, which likely reduces the cost and complexity of the motor, transmission, and controller.

Figure 2:
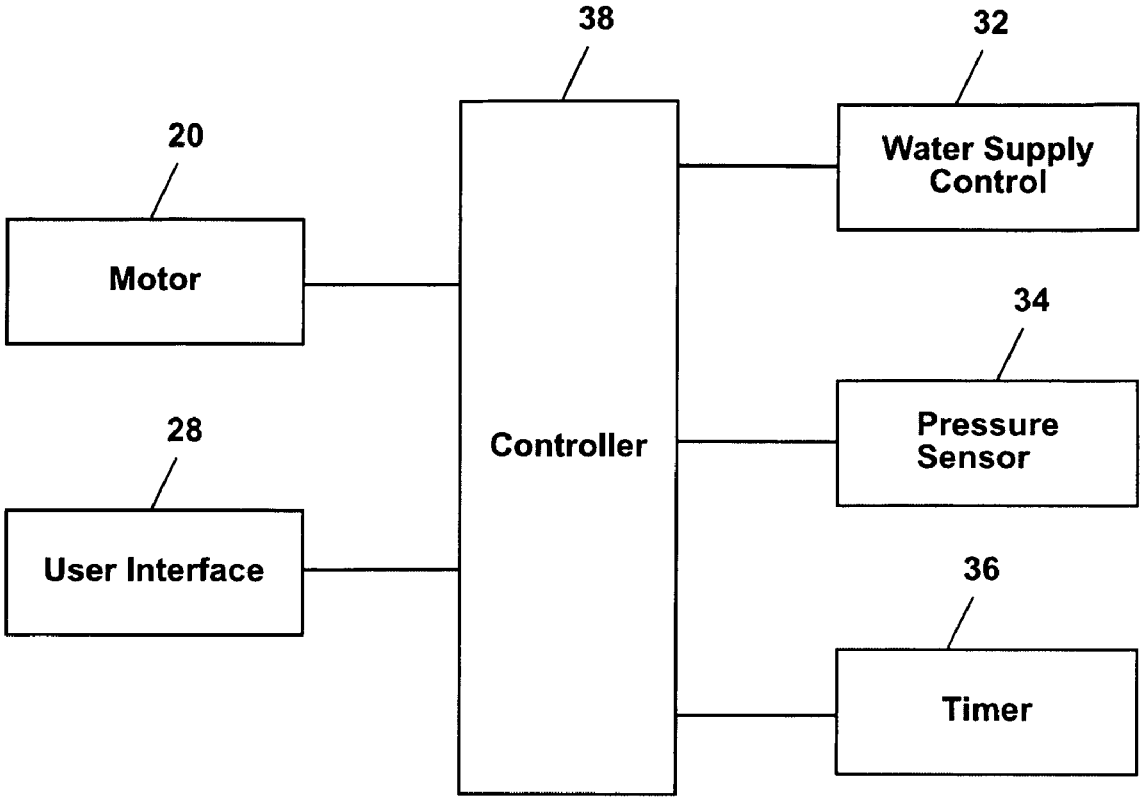
FIG. 2 is a schematic view of a control system according to one embodiment of the invention for the washing machine of FIG. 1.

Referring now to FIG. 2, the washing machine 10 further includes a water supply control 32, a pressure sensor 34, and a timer 36. The water supply control 32 may include one or more valves, pumps, and/or other flow control devices operable to selectively fluidly communicate an external water supply (not shown) with the tub 14 or the spraying system 40. When the water supply control 32 controls the supply of water to the tub, the level of water in the tub 14 may be detected by the pressure sensor 34, which may be positioned in any suitable location for detection of the water level in the tub 14. The pressure sensor 34 may be any suitable type of pressure sensor, including a dome-type pressure sensor, as is well-known in the art. The timer 36 may be employed to time one or more processes in the washing machine 10, including a time of supplying water to the tub 14.

A controller 38 communicates with several working components and/or sensors in the washing machine 10, such as the motor 20, the user interface 28, the water supply control 32, the pressure sensor 34, and the timer 36, to receive data from one or more of the working components or sensors and may provide commands, which may be based on the received data, to one or more of the working components to execute a desired operation of the washing machine 10. The commands may be data and/or an electrical signal without data. Many known types of controllers may be used for the controller 38. The specific type of controller is not germane to the invention.

The washing machine 10 shown in the figures and described herein is a vertical axis washing machine. As used herein, the "vertical axis" washing machine refers to a washing machine having a rotatable drum that rotates about a generally vertical axis relative to a surface that supports the washing machine. However, the rotational axis need not be vertical; the drum may rotate about an axis inclined relative to the vertical axis. Typically, the drum is perforate or imperforate and holds fabric items and a fabric moving element, such as an agitator, impeller, pulsator, infuser, nutator, ribbing or baffles on the interior wall of the basket or drum 16, and the like, that induces movement of the fabric items to impart mechanical energy directly to the fabric articles or indirectly through wash water in the drum for cleaning action. The clothes mover is typically moved in a reciprocating rotational movement, although non-reciprocating movement is also possible.

Although the washing machine 10 is a vertical axis washing machine, the methods described below may be employed in any suitable washing machine having a fabric moving element, including washing machines other than vertical axis washing machines. As used herein, "agitator" refers to any type of fabric moving element and is not limited to the structure commonly associated with an agitator, such as the structure shown in FIG. 1. Similarly, "agitate" refers to moving the fabric items and/or the water, regardless of the type of fabric mover inducing the movement of the fabric items and the type of motion of the fabric mover to induce the movement.

Typically, a washing machine performs one or more manual or automatic operation cycles, and a common operation cycle includes a wash process, a rinse process, and a spin extraction process. Other processes for operation cycles include, but are not limited to, intermediate extraction processes, such as between the wash and rinse processes, and a pre-wash process preceding the wash process, and some operation cycles include only a select one or more of these exemplary processes. Regardless of the processes employed in the operation cycle, the methods described below relate to determining a size of the fabric load and/or setting an operational water level for a process in the operation cycle.

Figure 3:
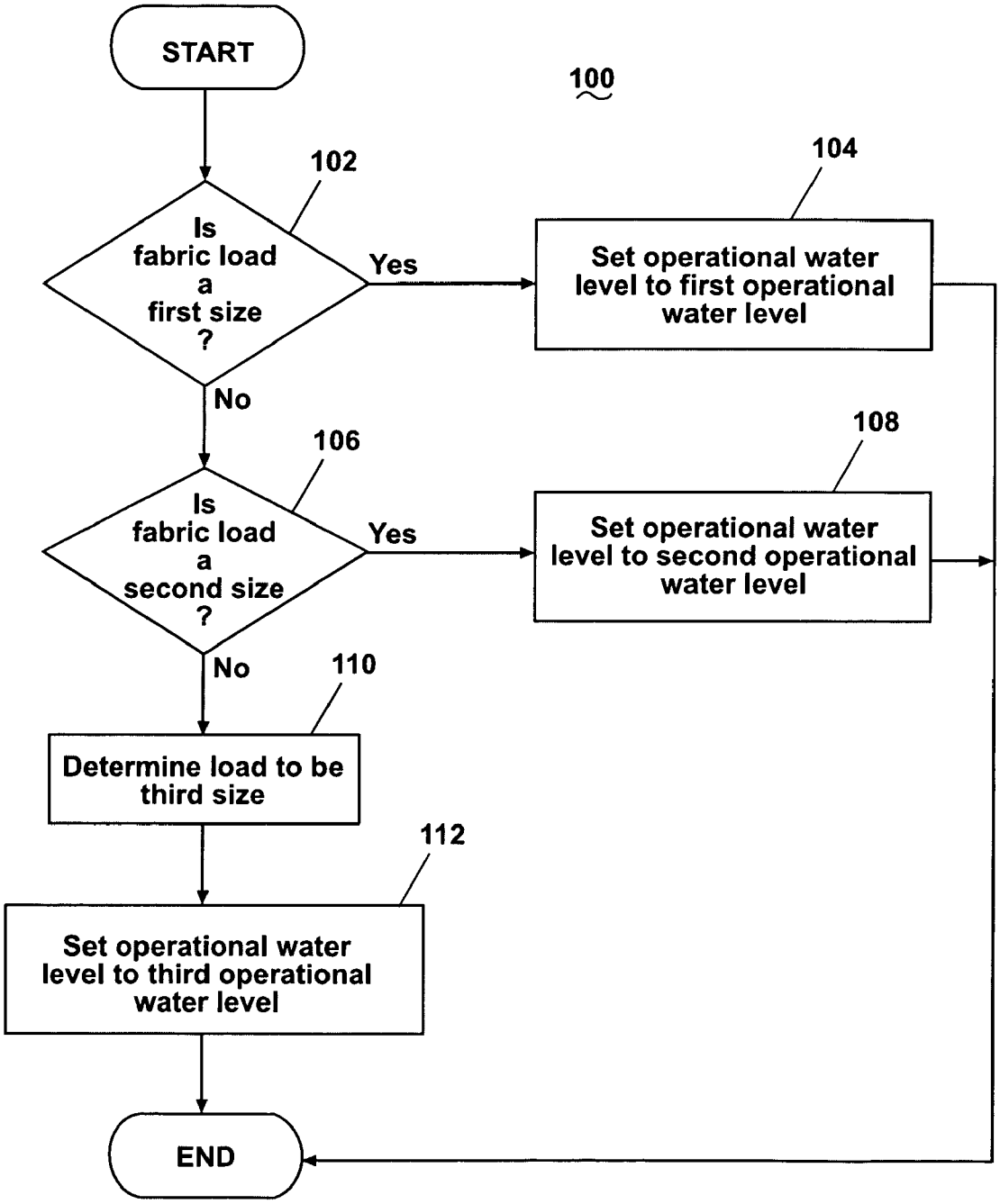
FIG. 3 is an exemplary flow chart of a method for determining load size and/or setting an operational water level in the washing machine of FIG. 1 according to one embodiment of the invention.

FIG. 3 provides a flow chart corresponding to a method 100 of operating the washing machine 10 according to one embodiment of the invention. The method 100 may be implemented in any suitable manner, such as in an automatic or manual operation cycle of the washing machine 10. The method 100 may be conducted as part of a wash process or other suitable process, such as a pre-wash or rinse process, of the operation cycle. Regardless of the implementation of the method 100, the method 100 may be employed to determine a size of the fabric load and/or set an operational water level for the associated process, which will be described as the wash process hereinafter for illustrative purposes.

The flow chart in FIG. 3 provides an overview of the method 100 according to one embodiment of the invention. The method 100 begins with a first determination at a step 102 of whether the load size is determined to be a first size. If the fabric load is determined to be the first size (discussed below), then a corresponding operational water level is set at step 104. An operational water level is a level of the volume of water used in the wash cycle for the determined load size. On the other hand, if the fabric load is determined to not be the first size, then the method 100 proceeds with a second determination at a step 106 of whether the load size is determined to be a second size greater than the first size (also discussed below). If the fabric load is determined to be the second size, then the operational water level is set at a step 108 to a second operational water level, which happens to be greater than the first operational water level. Alternatively, if the fabric load is determined to not be the second size, then the load size is determined at step 110 to be a third size greater than the second size, and the operational water level is set at a step 112 to a third operational water level greater than the second operational water level. After the load size is determined and/or the operational water level is set, the process associated with the method 100 continues in any desired manner.

The term operational water level is used to reference the level of water in the tub corresponding to a volume of water for implementing one or more steps of a wash cycle. The term operational water level is to be distinguished from the term water level, which is used to reference any water level in the tub and expressly includes operational water levels.

Figure 4:
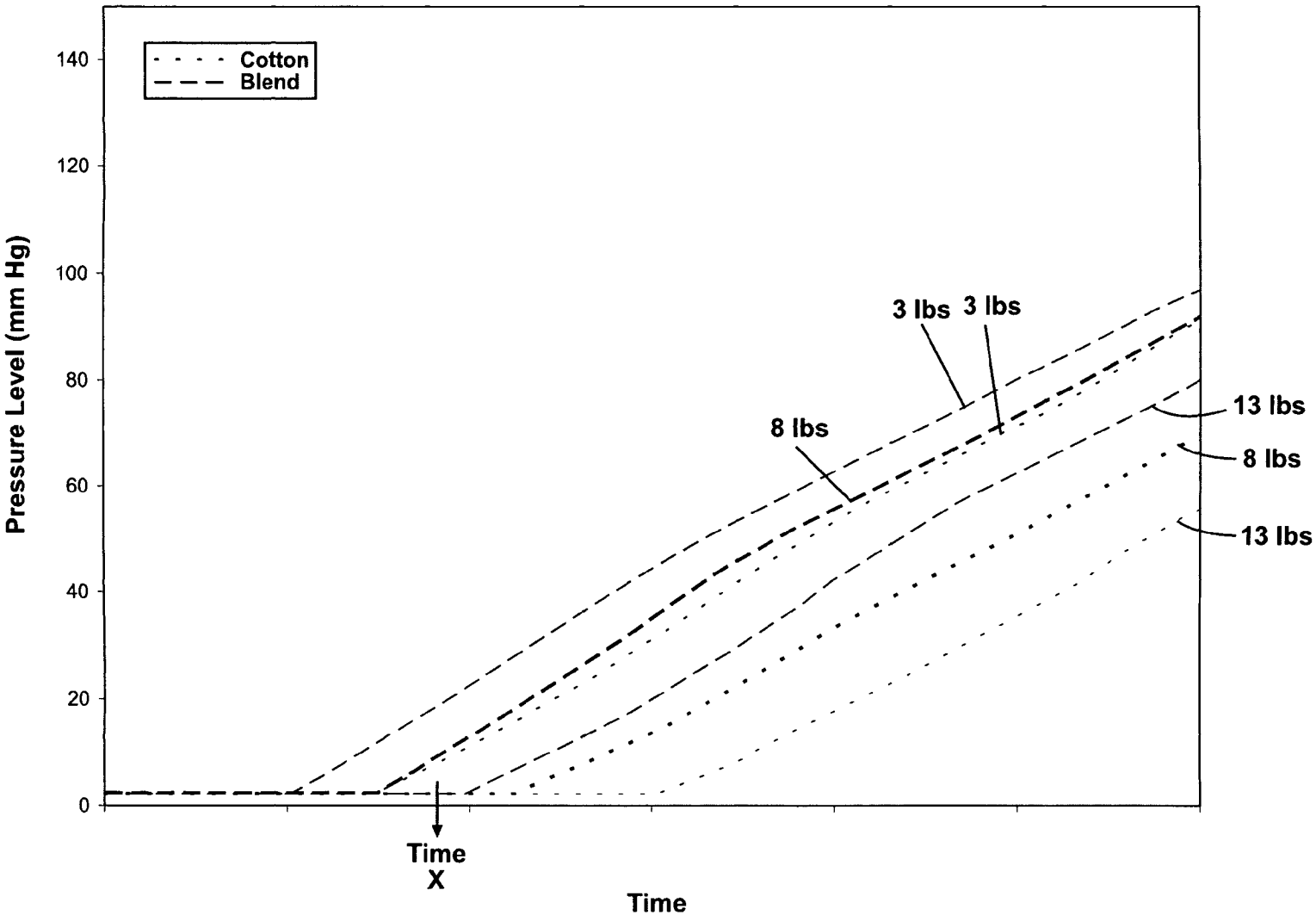
FIG. 4 is an exemplary graph of pressure level as a function of time for an initial water supply illustrating time to reach a timing water level for various fabric load weights having various fabric types.

Referring generally to FIG. 4, the logic underlying the method of the invention will be explained. The amount of water absorbed by the fabric load during the initial fill has been found to be indicative of the relative load size, such as whether the load is a relatively small size or is larger or smaller than another load. For similar types of fabrics, a smaller fabric load absorbs less water than a larger fabric load. For a given flowrate, this leads to the relatively small load taking less time to saturate than a larger load. The result is that water will start collecting in the tub in less time for a small load than for a larger fabric load. Therefore, the time it takes for water to start to collect in the tub or to collect to a predetermined water level, the time to fill, may be used as an indicator of the size of load.

There may not an exact correlation between the time for water to start collecting in the tub and the load size because of environmental factors. For example, if the load is small enough, it may not cover the bottom of the basket 16 and the water would pass directly from the spraying system 40 and into the tub. This may be referred to as the water bypassing the clothing, which tends to result in the time value indicating a smaller load than is present. The fabric load may also be placed in the basket 16 in such a way that water will pool on the fabric and not be absorbed, which tends to result in the time value indicating a larger load than is present. The mix of fabrics in the fabric load may also affect the time to fill the tub 14. For example, a fabric load of synthetic fabrics typically absorbs less water than the same size fabric load of cotton fabrics; thus, the time to fill the tub 14 with water to a predetermined water level may be less for the synthetic fabric load than for the cotton fabric load. These potential errors in the accuracy of the time to fill and the actual load size may be addressed by the selection of operational water levels that span any anticipated error.

While the time to fill may be determined by filling to any water level, to minimize the cycle time, the time to fill determination may be measured until the pressure sensor first begins to sense water in the tub. When the pressure sensor first senses water in the tub is sometimes referred to as the first meaningful output from the pressure sensor 34. The first meaningful output of the pressure sensor typically corresponds to a water level in the tub. That is, it is the first sensed water level that the pressure sensor can sense. This first sensed water level depends, at least in part, on the configuration of the washing machine 10, such as the location of the pressure sensor 34. Alternatively, the first sensed water level may correspond to a predetermined output from the pressure sensor 34, which is indicative of a water level above the first sensed water level. However, terminating the time to fill at a water level above the first sensed water level will increase the overall cycle time. The first sensed water level may be less than, equal to, or greater than a level of water for a wash process of an operation cycle of the washing machine 10. As one example, the first sensed water level may be about 1 inch of water in the tub 14. For purposes of this description, the time to fill (t) will be described in the context of the time to fill to the first sensed water level, with it being understood that any water level may be used as the level for terminating the time to fill. Therefore, the term timing water level will be used to generically refer to the water level at which the time to fill is determined, with it being understood that this term may apply to any water level and not limited by the manner in which the water level is sensed.

The relationship between load size and time to fill is illustrated in FIG. 4, which contains example plots of pressure verses time for a pressure sensor for different combinations of load sizes and load types as water is being introduced onto the fabric load. The pressure sensor used for the plots is a dome-type pressure sensor located in the tub 14 beneath the basket 16. The illustrated load sizes are 3 lb, 8 lb, and 13 lb. The illustrated load types are a blend (shown in dashed lines) of cotton and synthetic fabrics and a 100% cotton load (shown in dotted lines). Each combination of load size and load type is represented by a different plot line. For ease of viewing understanding, transient variations in the actual test data has been removed from the plots and only the general trend is plotted.

Each plot line has the same general shape where the pressure remains constant (horizontal portion) and then, at an inflection point, trends upwardly (angled portion). The horizontal portion represents the time when water is being added to the basket 16 but the sensor does not yet sense any water in the tub. That is, the water in the tub has not yet reached the timing water level. Most of the water during this time is being absorbed by the fabric load. The inflection point represents the time when the sensor first senses water in the tub and is the timing water level. That is, the time it takes to reach the inflection point is the time to fill. After the inflection point is reached, most of the additional water is not absorbed by the fabric load and goes into the tub, resulting in an increase in the water level, which results in an increased pressure sensed by the pressure sensor.

In comparing the various plots, it can be seen that for a given fabric load type, the time to reach the inflection point, i.e., the time to fill, increases with load size. This is true for either the blend load type or the all cotton load type. Therefore, the time to fill may be used to determine relative load sizes.

It can also be seen that in some instances this correlation does not hold true if there is when there is a large difference in the absorbency of the fabric types. For example, the 3 lb cotton load reaches its inflection point about the same time as the 8 lb blend load, and the 8 lb cotton load reaches its inflection point after the 13 lb blend load. To address the variation attributable to the absorbency variation of the load types, the time to fill and corresponding operation water level may be selected to obtain the best/desired wash performance. For example, in a vertical axis machine, operational water levels are usually set based on the weight of the fabric load and it is generally considered better to have too much water for a given load weight than too little water because it minimizes the wear on the clothing from the agitator and has better wash performance. Therefore, the inflection points for the blend loads may be used as indicators for the cotton loads to ensure that enough water is added when setting the operational water level.

The plots in FIG. 4 are for a constant volumetric water flow rate. However, for differing flow rates, the plots may exhibit differing behavior. For example, a greater flow rate corresponds to a greater rate of increasing pressure level (i.e., the plots would be steeper), and, conversely, a lesser flow rate corresponds to a smaller rate of increasing pressure level 1 (i.e., the plots would be less steep). Additionally, the time to reach a given water level in the tub 14 depends on the flow rate; a greater flow rate corresponds to a faster time, and a slower flow rate corresponds to a slower time.

Figure 5:
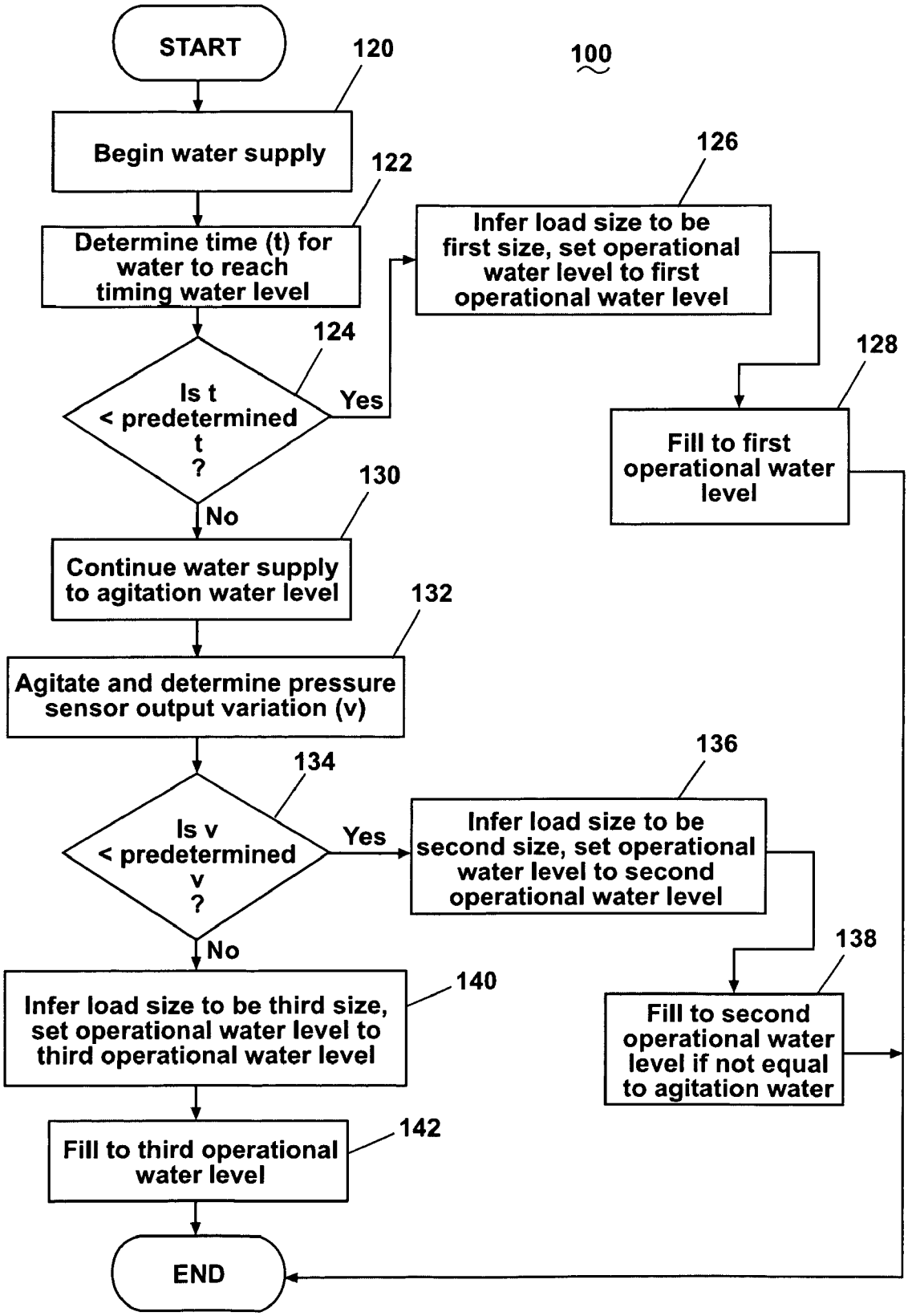
FIG. 5 is an exemplary flow chart of an implementation of the method of FIG. 3 according to one embodiment of the invention.

With this background, an exemplary implementation of the method in FIG. 3 will be described with respect to the flow chart in FIG. 5. The implementation of the method 100 includes a step 120 of beginning water supply to the tub 14. In one embodiment, the fabric load is typically in a dry or nearly dry condition in the basket 16 before the water is supplied, although in other embodiments the fabric load could be in varying degrees of wetness. The time (t) to fill the tub to the timing water level is determined in step 122. The method 100 determines if the time to fill meets a first predetermined condition that is indicative of a first load size at step 124. If the time to fill meets the first predetermined condition, then the method 100 infers that the fabric load is the first load size. In particular, for this example, the time for the water to reach the timing water level in the tub 14 determined at a step 122 may be compared to an empirically (or otherwise) determined predetermined time, such as the time to reach an inflection point described in FIG. 4, at a step 124. If the time is less than the predetermined time, then at step 126, the method 100 infers the load size to be the first size, which may be a small size, and sets an operational water level to the first, typically lowest, operational water level, which for purposes of this example may be thought of as the small load size operational level. If the first operational water level is greater than the timing water level, such as in the example above, then the water may be supplied to fill the tub to the first operational water level in a step 128. In one embodiment, the first operational water level is greater than the timing water level and may be about 7 inches in the tub 14. Further, it is contemplated that the initial water supply to reach the timing water level and the water supply to reach the first operational water level in the steps 120 and 128 may be a continuous supplying of water or may be supplying of water in multiple, discrete steps. If it is determined that the first predetermined condition is not met, i.e., the time is not less than the predetermined time in the step 124, then the method 100 continues with the supply of water in a step 130 to an agitation water level. The agitation water level may be any water level greater than the timing water level, and, in one embodiment, the agitation water level may be, for example, about 9 to 10 inches of water in the tub 14. Further, the supply of water from the timing water level and to the agitation water level may be continuous, such that the decision in the step 124 occurs while water is being supplied, or discrete, such that the water supply ceases while the decision in the step 124 is made.

At the agitation water level, the agitator 18 (or other clothes mover) rotates or otherwise agitates the fabric load and the water in the tub 14 during a step 132. Additionally, the output from the pressure sensor 34 may be monitored and employed for determining whether the fabric load is a second size greater than the first size. The agitation may occur for any suitable time, and an exemplary agitation time is about 6 seconds. The agitator 18 may rotate at any suitable speed, and, if the agitation comprises reciprocal rotation of the agitator 18, the agitator 18 may rotate in each direction for any suitable time.

Variation in the output signal from the pressure sensor 34 during agitation of the fabric load and the water in the tub 14 may be indicative of the load size. The exact cause of the variation in the output signal is not completely known. It is currently thought that as the agitator 34 rotates, the fabric load moves, the water in the tub 14 moves and may splash, and the tub 14 itself may move or wiggle. One or more of these effects may result in a ripple or variation in the output from the pressure sensor 34, and the magnitude of the ripple or variation increases with increasing load size.

Because the magnitude of the variation in the output from the pressure sensor 34 may be indicative of the load size, the method 100 employs the variation to infer whether the fabric load is a second size greater than the first size. The method 100 determines if the variation meets a second predetermined condition; if the variation meets the second predetermined condition, then the method 100 infers that the fabric load is the second size. In particular, for this example, the variation determined at the step 132 is compared to an empirically (or otherwise) determined predetermined variation at a step 134. If the variation is less than the predetermined variation, then at step 136, the method 100 infers the load size to be the second size, which may be a medium size, and sets the operational water level to a second operational water level, which, for this example, may be thought of as a medium load size operational water level. If the second operational water level is greater than the agitation water level, then the water may be supplied to the second operational water level in a step 138. In one embodiment, the second operational water level is equal to the agitation water level, in which case, no further water supply occurs at the step 138.

Figure 6:
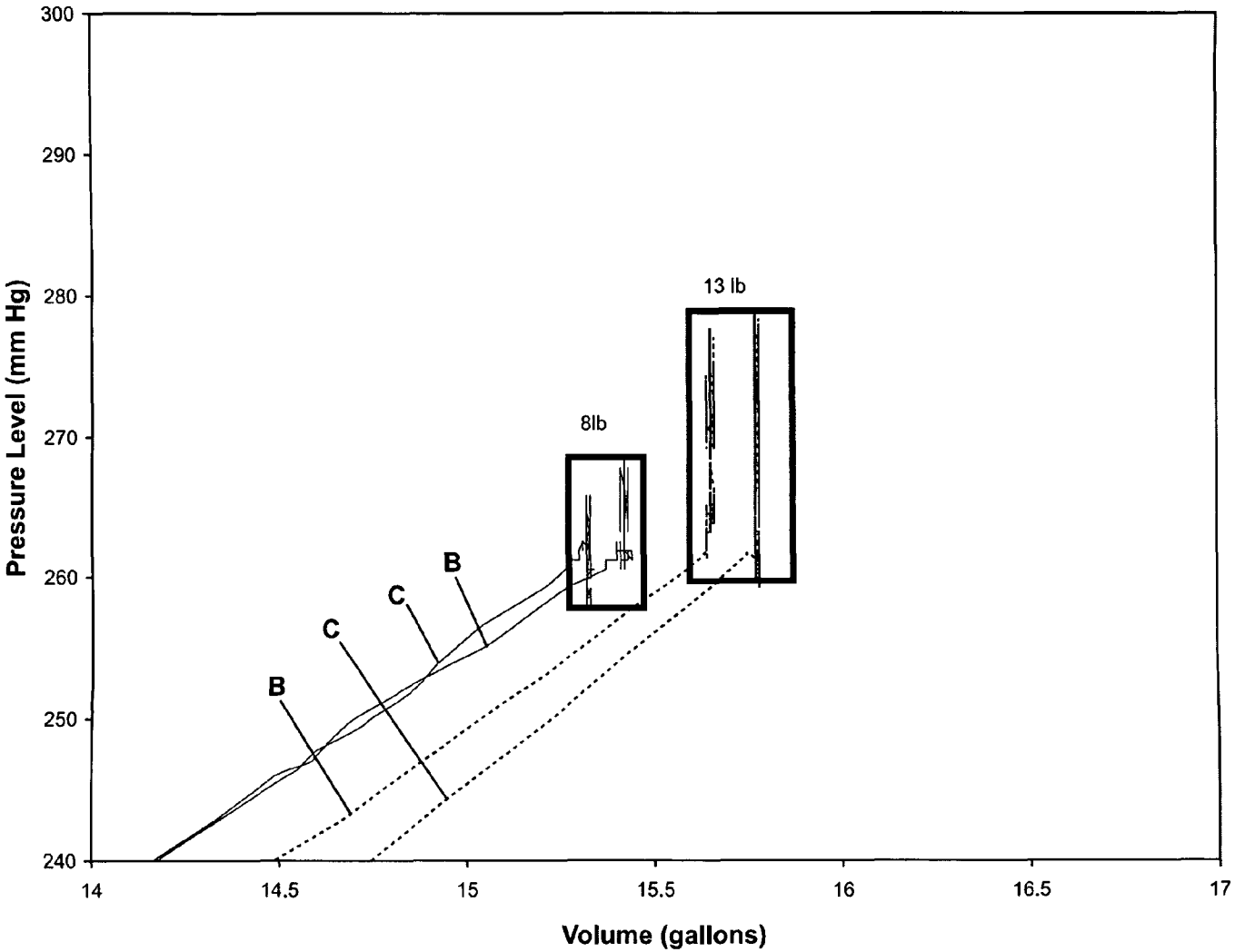
FIG. 6 is an exemplary graph of pressure level as a function of volume of supplied water illustrating variation of the pressure level while agitating various fabric load weights having various fabric types.

If the variation is determined not to be less than the predetermined variation at the step 134, then the load size is inferred to be a third size, greater than the first and second sizes. In one embodiment, the third size may be a large load size. Additionally, the water level may be set to a third operational water level, greater than the first and second operational water levels. The third operation water level may be thought of as the large load size operational level for this example. In one embodiment, the third operational water level may correspond to about 14 inches of water in the tub 14. If the load size is inferred to be the third load size in the step 140, then the water may be supplied to the third operational water level in a step 142. The graph in FIG. 6 provides an example of pressure level, which is the output from the pressure sensor 34, as described above, as a function of volume of water supplied to the tub 14 for fabric loads of 8 pounds (solid lines) and 13 pounds (dotted lines)for both the blend "B" and cotton "C" load types. For ease of viewing and understanding, transient variations in the actual data have been removed from the plotted data.

When the pressure level reaches a level indicative of the agitation water level, which is slightly greater than 260 mm Hg in the exemplary graph, the agitation occurs and induces the variation in the magnitude of the pressure level. The variation in the output from the pressure sensor 34 is clearly smaller for the 8 pound loads, about 8 mm Hg, than for the 13 pound loads, about 15 mm Hg or greater, regardless of the load type. If the predetermined variation is selected to be between about 8 and less than about 15 mm Hg, then all of the 8 pound fabric loads would be inferred to be the second size, and all of the 13 pound loads would be inferred to be the third size.

After the load size is inferred and/or the operational water level is set during one of the steps 126, 136, and 140 and, optionally, water supplied to the corresponding operational water level during one of the steps 128, 138, and 142, the process associated with the method 100 continues in any desired manner.

In the method 100, the operational water level may be set without a corresponding inference of load size and vice-versa. It is contemplated that the method 100 may be employed only for setting the operational water level, in which case the inference of the load size may not be necessary. It is also contemplated that the method 100 may be employed for only determining the load size, and the inferred load size may thereafter be employed to determine other parameters for the operation cycle. It is also contemplated for the method 100 to both infer the load size and set the operational water level.

When the method 100 is employed for determining load size, the inferred load size may be a qualitative load size wherein the fabric load is assigned to a category, such as small, medium, and large, of load size based on the qualities of the fabric load. That is, the size of the load is not weighed or otherwise to directly measured to obtain a quantitative or numerical measurement. While the qualitative load size does not correlate with a direct numerical measurement of the weight or volume of the fabric load, an estimated or empirical weight or weight range may be associated to the qualitative load size (e.g., a medium load size may be described as an 8-12 pound load size). Further, a qualitative load size, which, as described above, may be indicative of both the weight of the fabric load and the type of fabric load.

The method 100 may be adapted for determining more or less than three load sizes, and, similarly, setting more or less than three operational water levels. In one example, the variation in the output from the pressure sensor 34 may be compared to more than one predetermined variation, which may enable more load sizes and operational water levels. For example, using two predetermined variations, wherein each predetermined variation defines between two load sizes and/or operational water levels, allows the use of a fourth load size, which may be an extra large load size, and/or a fourth operational water level.

The time and the variation of the output from the pressure sensor 34 may be employed directly as a time and a pressure level for the decisions made in the steps 124, 134 or may be modified in any suitable manner. In other words, the time and/or the pressure sensor output may be altered, such as by being multiplied by another variable, to refine the variables.

The method 100 may be adapted for use with different washing machines and differing water flow rates. Various aspects, such as the predetermined time and variation and number of load sizes and operational water levels, may depend on the configuration of the washing machine 10 and the external water supply. The particular shape of a curve of pressure level as a function of time may change for differing configurations of washing machines, and the curves may shift along the time axis for differing water flow rates (e.g., shift to longer times for lower water flow rates), but the relative behavior of pressure level as a function of time for a group of given fabric load weights and fabric types using a given washing machine configuration with a given water flow rate should remain the same or at least similar enough so that the method 100 may be applied regardless of the washing machine configuration and water flow rate.

The method 100 may be used for an automatic water level control system in lower end washing machine having simple electromechanical components, such as the timer. The method 100 may also be combined with a flow meter, flow restrictor, alternate fill method, and/or inputs by the user, such as fabric type.

The above description and the figures refer to the supply of water to the tub 14. The water may be water alone or water in combination with an additive, such as a wash aid, including, but not limited to a detergent, a bleach, an oxidizer, a fabric softener, etc. Any additive supplied to the tub 14, either through a detergent dispenser or manually added directly into the basket 16 or the tub 14, may affect the output of the pressure sensor 34, and the empirically determined predetermined time and variation(s) may be set to account for such effects.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for determining a size of a fabric load in a washing machine comprising a wash tub, an agitator for agitating a fabric load in the tub, and a pressure sensor for sensing a level of water in the tub, the method comprising:

supplying water to the tub;

determining a time for the water in the tub to reach a timing water level;

determining whether the fabric load is a first qualitative size based on the determined time; and determining whether the fabric load is a second qualitative size, greater than the first qualitative size, based on variation in an output from the pressure sensor during agitation of the water and fabric load at a water level less than an operational water level for the second qualitative size, when the fabric load is not a first qualitative size.

2. The method according to claim 1, further comprising determining that the fabric load is a third qualitative size, the third qualitative size being a size greater than the second qualitative size, when the fabric load is not the first qualitative size or the second qualitative size.

3. The method according to claim 1 wherein the reaching of the timing water level is detected by an initial meaningful output from the pressure sensor.

4. The method according to claim 1 wherein the determining whether the fabric load is the first qualitative size comprises comparing the time to a predetermined time.

5. The method according to claim 4 wherein the determining whether the fabric load is the first qualitative size comprises determining that the fabric load is the first qualitative size when the time is less than the predetermined time.

6. The method according to claim 1 further comprising supplying water to the tub and determining the time for the water to reach the timing water level.

7. The method according to claim 6 wherein the agitation of the water and fabric load occurs with the water at an agitation water level in the tub, with the agitation water level being greater than the timing water level.

8. The method according to claim 7 further comprising supplying water to the agitation water level, agitating the water at the agitation water level, and determining the variation of the pressure sensor output during the agitation.

9. The method according to claim 1 wherein the determining whether the fabric load is the second qualitative size comprises comparing the magnitude of the variation in the pressure sensor output to a predetermined variation in the pressure sensor output.

10. The method according to claim 9 wherein the determining whether the fabric load is the second qualitative size comprises determining that the fabric load is the second qualitative size when the magnitude of the variation in the pressure sensor output is less than the predetermined variation in the pressure sensor output.

11. The method according to claim 1 wherein the timing water level in the tub is less than a washing level in the tub.

12. The method according to claim 1 wherein the determining whether the fabric load is the first qualitative size further comprises:

supplying water to the tub;

determining the time for the water to reach the timing water level;

comparing the time to a predetermined time; and determining that the fabric load is the first qualitative size when the time is less than the predetermined time.

13. The method according to claim 12 wherein determining whether the fabric load is the second qualitative size further comprises:

supplying water to an agitation water level;

rotating the agitator with the water at the agitation water level;

determining the variation in the pressure sensor output during the rotation of the agitator;

comparing the magnitude of the variation in the pressure sensor output to a predetermined variation in the pressure sensor output; and determining that the fabric load is the second qualitative size if the pressure sensor output variation is less than the predetermined pressure sensor output variation.

14. The method according to claim 13, further comprising determining that the fabric load is a third qualitative size greater than the second qualitative size when the fabric load is not the first qualitative size or the second qualitative size.

15. The method according to claim 1, further comprising setting an operational water level in the tub to a first operational water level if the fabric load is determined to be the first qualitative size and setting the operational water level in the tub to a second operational water level greater than the first operational level if the fabric load is determined to be the second qualitative size.

16. The method according to claim 15 further comprising determining that the fabric load is a third qualitative size greater than the second qualitative size if the fabric load is not the first qualitative size or the second qualitative size and setting the operational water level in the tub to a third operational water level greater than the second operational level if the fabric load is determined to be the third qualitative size.

17. A method for setting an operational water level in a washing machine comprising a wash tub for containing a fabric load, an agitator for agitating a fabric load in the tub, and a pressure sensor for sensing a level of water in the tub, the method comprising:

supplying water to the tub;

determining a time of water supplied to reach a timing water level in the tub;

setting the operational water level in the tub to a first operational water level when the time meets a first predetermined condition;

rotating the agitator and determining a variation in output from the pressure sensor during the rotation of the agitator at a water level less than a second operational water level when the time does not meet the first predetermined condition; and setting the operational water level in the tub to the second operational water level greater than the first operational level when the pressure sensor output variation meets a second predetermined condition when the time does not meet the first predetermined condition.

18. The method according to claim 17, further comprising increasing the water from the timing water level in the tub to an agitation water level in the tub, wherein the rotating of the agitator occurs with the water at the agitation water level in the tub.

19. The method according to claim 17, further comprising setting the operational water level in the tub to a third operational water level, the third operational water level being greater than the second operational water level, when the pressure sensor output variation does not meet the second predetermined condition.

20. The method according to claim 17 wherein the reaching of the timing water level in the tub is detected by an initial meaningful output from the pressure sensor.

21. The method according to claim 17 wherein the first predetermined condition comprises comparing the time to a predetermined time.

22. The method according to claim 21, wherein the first predetermined condition is met when the time is less than the predetermined time.

23. The method according to claim 22, further comprising increasing the water from the timing water level in the tub to an agitation water level in the tub, wherein the rotating of the agitator occurs with the water at the agitation water level in the tub, further wherein the second predetermined condition comprises comparing the magnitude of the variation in the pressure sensor output to a predetermined variation in the pressure sensor output, and the second predetermined condition is met when the magnitude of the variation in the pressure sensor output is less than the predetermined variation in the pressure sensor output.

24. The method according to claim 23, further comprising setting the operational water level in the tub to a third operational water level greater than the second operational level when the magnitude of the pressure sensor output variation does not meet the second predetermined condition.

25. The method according to claim 17 wherein the second predetermined condition comprises comparing the magnitude of the pressure sensor output variation to a predetermined pressure sensor signal variation.

26. The method according to claim 25 wherein the second predetermined condition is met when the magnitude of variation in the pressure sensor output is less than the predetermined variation in the pressure sensor output.

* * * * *